US005862712A

United States Patent [19]

Guilleminot et al.

[11] Patent Number: 5,862,712

[45] Date of Patent: Jan. 26, 1999

[54] FRONT PANEL OF AN ELECTRONIC APPARATUS, PROVIDED WITH A PUSH-BUTTON

[75] Inventors: Pierre Guilleminot, Hermeray; Bruno Aubert, Epernon, both of France

[73] Assignee: Mannesmann VDO AG, Germany

[21] Appl. No.: 722,647

[22] Filed: Sep. 30, 1996

[30] Foreign Application Priority Data

Oct. 4, 1995 [FR] France ..... 95 11668

[51] Int. Cl.[6] ..... G05G 1/00

[52] U.S. Cl. ..... 74/503; 200/331; 455/346; 455/348

[58] Field of Search ..... 74/503; 200/330, 200/382, 517; 455/345, 344, 346, 347, 348, 349, 351

[56] References Cited

U.S. PATENT DOCUMENTS

| | | | |
|---|---|---|---|
| 3,978,304 | 8/1976 | Salvati et al. | 200/331 |
| 4,011,423 | 3/1977 | Zepp | 200/330 |
| 5,185,804 | 2/1993 | Watanabe | 455/348 X |
| 5,637,928 | 6/1997 | Nakajima et al. | 455/346 X |

FOREIGN PATENT DOCUMENTS

| | | | |
|---|---|---|---|
| 0566128 | 10/1993 | European Pat. Off. . | |
| 0566128A3 | 10/1993 | European Pat. Off. . | |
| 572860 | 12/1993 | European Pat. Off. | 74/503 |
| 3010515 | 9/1981 | Germany . | |

*Primary Examiner*—Charles A. Marmor
*Assistant Examiner*—Saúl J. Rodríguez
*Attorney, Agent, or Firm*—David M. Thimmig; Mayer Brown & Platt

[57] ABSTRACT

A detachable front panel of an electronic device, containing push-buttons corresponding to actuating rods in the chassis of the device. The push buttons are provided with springs which urge the buttons against the actuating rod, and causes the buttons to be moved into the front panel when the panel is detached from the device.

8 Claims, 1 Drawing Sheet

FRONT PANEL OF AN ELECTRONIC APPARATUS, PROVIDED WITH A PUSH-BUTTON

BACKGROUND OF THE INVENTION

1. Field of the Invention

The present invention relates to a front panel intended to be mounted on the front surface of an electronic home-entertainment apparatus, which front surface carries an actuating rod which projects from said surface and is actuated by pushing, which front panel is provided with a slide button secured to it and arranged so as to be disposed opposite the actuating rod when the front panel has been mounted on the apparatus.

2. Description of the Related Arts

Such a detachable front panel is known from the document EP 0,566,128. In accordance with said document a removable front panel carries push-buttons corresponding to push-buttons which project from the front surface of the chassis, for controlling a cassette player.

SUMMARY OF THE INVENTION

It is an object of the invention to improve the operation of the control keys or buttons.

To this end, the front panel has been provided with a spring which tends to urge the slide button into the front panel.

Since in certain modes of the cassette player the actuating rod remains depressed halfway, the spring ensures that the slide button is always in engagement with the rod, even when it is depressed halfway, which precludes "floating" of the button or vibrations.

Moreover, if the front panel is of an anti-theft type which can be removed by a user, the button is moved inward under the influence of the spring when the front panel is removed: there is no part which projects from the front panel and which could be caught, for example, in a pocket of the user.

It is advantageous if the thickness of the front panel, on the one hand, and the length of the button, on the other hand, are such that the button, when depressed, is disposed almost wholly inside the front panel.

Thus, the button can disappear completely inside the front panel when this panel is removed.

It is advantageous if the spring is a hairpin spring, which can have one limb which engages a transverse hole of the button.

A front panel in accordance with the invention is particularly suitable for use in a car-radio receiver having a front panel which carries an actuating rod which projects from said panel and is actuated by pushing.

The actuating rod is for example an actuating rod of a cassette player.

These as well as other more detailed aspects of the invention will be apparent from the following description of an embodiment given by way of non-limitative example.

DESCRIPTION OF THE PREFERRED EMBODIMENTS

It is evident that the invention, which will be described hereinafter in connection with a car-radio receiver having an detachable anti-theft front panel, can likewise be applied to any other type of apparatus and is still advantageous even if the front panel is not of the anti-theft type which is removable by the user.

Figure 1:
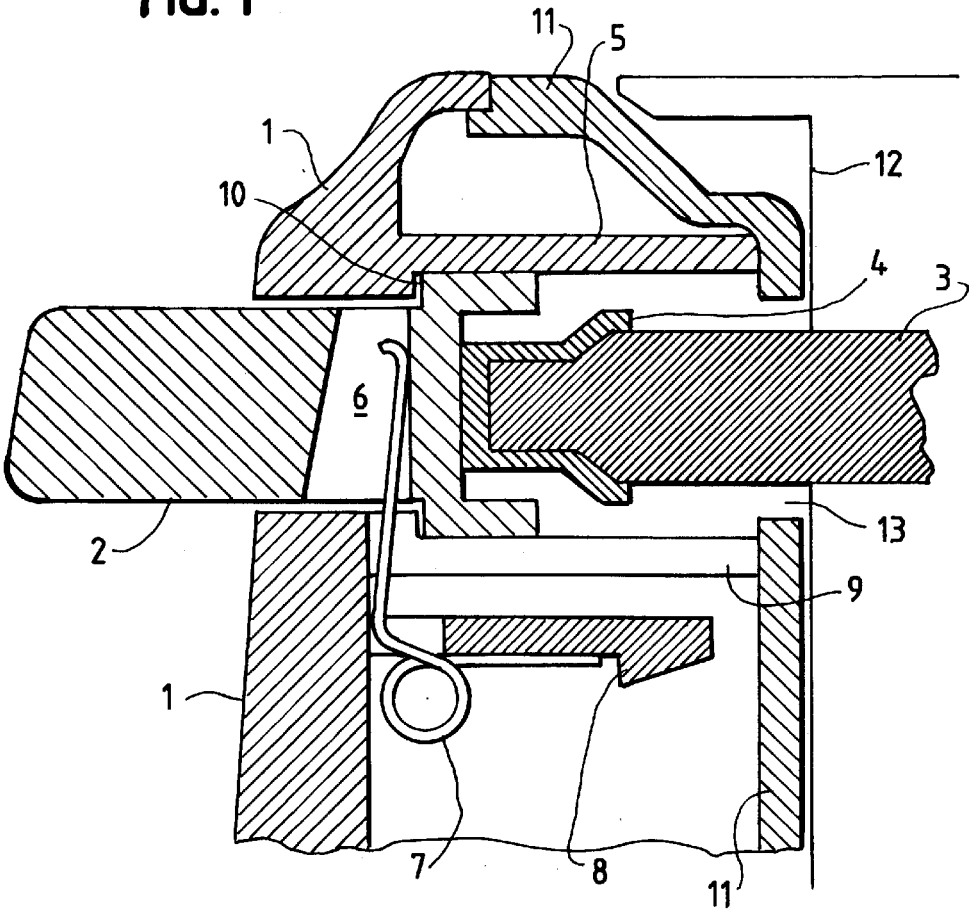
FIG. 1 shows a part of a car-radio receiver with elements of the invention, inter alia a part of a removable front panel.

The removable front panel of a car-radio receiver, which is shown partly in FIG. 1, is made up of two elements, i.e. a front wall 1 (facing the user), turned to the left in the figure, and a rear wall 11, adapted to be applied to at least a part of the front surface of the apparatus. The front panel carries a control button 2, which projects from the front wall 1.

The receiver chassis is formed by a housing which accommodates the most bulky elements of the receiver, such as a known cassette-player deck, not shown. The front surface of the chassis is symbolized by a line 12. The end 3 of an actuating rod projects from this front surface, which rod serves to control a function of the cassette reader, for example cassette ejection or fast winding. The rod 3 is made of a metal and its end is covered by a cap 4 of a plastic material. It has such a length that its end is disposed approximately halfway the thickness of the front panel.

The button 2 is mounted to be slidable in the front panel 1. In order to ensure a satisfactory mechanical mounting, the button is provided with a guide member 5,9 which allows it to slide in a support inside the front panel, and with a shoulder 10, which prevents the button from being moved out through the front wall of the front panel. Numerous variants of such a guide system are known to or are conceivable by those skilled in the art. The button 2 can be pushed towards the right in FIG. 1. It has a recess 6 forming a kind of tunnel through the body of the button, in which a limb of a hairpin spring 7 engages, which spring is also fastened to the front panel by means of a holder 8. The spring is tensioned so as to urge the button to the right in the figure, i.e. towards the front side of the chassis.

When the front panel has been mounted, as shown in FIG. 1, the button 2 faces the end of the actuating rod 3, and when the button is pushed the actuating rod is depressed.

Figure 2:
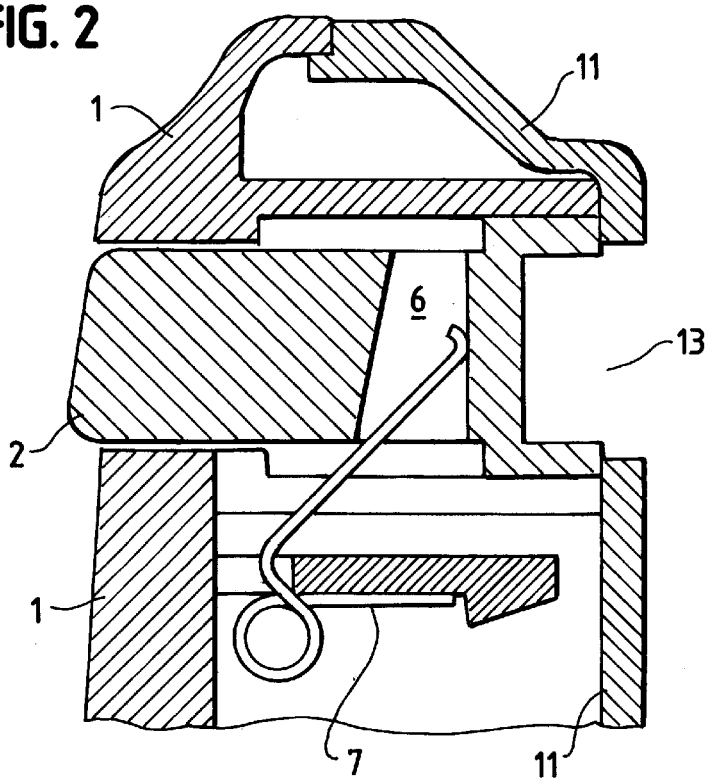
FIG. 2 shows a part of the removable front panel of the car-radio receiver of FIG. 1, while removed from the receiver and with a slide button pressed into it.

When the front panel has been removed, as shown in FIG. 2, the button 2 is urged into the front panel under the influence of the spring 7 and no longer projects from the front wall 1. The front panel has a thickness of the same order as the length of the button and the button is then disposed almost wholly inside the front panel.

Some variants can be easily imagined. For example, the spring can have two limbs that engage on both sides of the button, instead of one limb engaging a transverse hole. A sole spring could be used for two contiguous buttons, having a central support and two symmetrical limbs, each of them engaging a transverse hole of a button.

We claim:

1. A front panel having a rear surface that is adapted to be mounted to a front surface of an electronic apparatus carrying an actuating rod which projects from the front surface and is actuated by pushing, which front panel comprises a slide button secured to it and arranged so as to be disposed opposite the actuating rod when the front panel has been mounted on the apparatus, wherein the front panel comprises a spring which tends to urge the slide button into the front panel in a direction toward the rear surface of the front panel.

2. A front panel as claimed in claim 1, wherein the front panel has a thickness, and the button has a length, and.

the thickness of the front panel, and the length of the button, are such that the button, when depressed, is disposed almost wholly inside the front panel.

3. A font panel as claimed in claim 1, wherein the spring is a hairpin spring.

4. A front panel as claimed in claim 1, wherein the spring is a hairpin spring having one limb which engages a transverse hole of the button.

5. A car-radio receiver comprising an electronic circuit within a chassis having a front surface and a front panel intended to be mounted on the front surface, the front panel having a rear surface that is adjacent to said front surface when the front panel is mounted on the front surface, which front surface carries an actuating rod which projects from said front surface for controlling the electronic circuit, which front panel comprises a button secured to it and arranged so as to be disposed opposite the actuating rod when the front panel has been mounted on the front surface, wherein the front panel comprises a spring which tends to urge the button into the front panel in a direction toward the rear surface of the front panel.

6. A car-radio as claimed in claim 5, wherein the front panel has a thickness, and the button has a length, and, the thickness of the front panel, and the length of the button, are such that the button, when depressed, is disposed almost wholly inside the front panel.

7. A font panel as claimed in claim 5, wherein the spring is a hairpin spring.

8. A front panel as claimed in claim 5, wherein the spring is a hairpin spring having one limb which engages a transverse hole of the button.

* * * * *